United States Patent [19]

Bostater et al.

[11] Patent Number: 4,493,359

[45] Date of Patent: Jan. 15, 1985

[54] METHOD FOR MAKING CAST IRON ENGINE BLOCKS AND THE LIKE

[75] Inventors: Joseph A. Bostater, Port Huron, Mich.; Angus J. MacGregor, Corunna; Aaron A. Gesicki, Sarnia, both of Canada

[73] Assignee: American Motors (Canada) Inc., Brampton, Canada

[21] Appl. No.: 284,028

[22] Filed: Jul. 17, 1981

[51] Int. Cl.[3] ..... B22D 27/20

[52] U.S. Cl. ..... 164/58.1; 164/57.1

[58] Field of Search ..... 164/55.1, 57.1, 58.1; 75/130 R, 130 A, 130 B

[56] References Cited

U.S. PATENT DOCUMENTS

| | | | |
|---|---|---|---|
| 1,955,481 | 4/1934 | Wirtz | 75/27 |
| 2,485,761 | 10/1949 | Millis et al. | 75/130 A X |
| 3,013,911 | 12/1961 | Peras | 75/130 R |
| 3,055,755 | 9/1962 | Schelleng | 75/130 R |
| 3,197,306 | 7/1965 | Osborn et al. | 75/130 A |
| 3,299,482 | 1/1967 | Tache et al. | 75/130 R |
| 3,375,106 | 3/1968 | McKissick et al. | 75/130 |

FOREIGN PATENT DOCUMENTS

| | | | |
|---|---|---|---|
| 1121639 | 1/1972 | Fed. Rep. of Germany . | |
| 0589274 | 1/1978 | U.S.S.R. | 75/130 R |
| 0489414 | 1/1978 | U.S.S.R. | 75/130 A |

OTHER PUBLICATIONS

"Legieren und Impfen von Kupolofeneisen in einem Reaktionsgefäss", *Giesserei-Praxis*, No. 12, Doelman et al., 6/25/81, pp. 205-217.

*Giesseri-Praxis*, No. 4, "Eigenschaften von legiertem Gusseisen mit Lamellengraphit bei höheren Temperaturen zur Verwendung in Dieselmotoren", Gundlach, 2/25/79, pp. 219-259.

*Primary Examiner*—Kuang Y. Lin

*Attorney, Agent, or Firm*—Brooks & Kushman

[57] ABSTRACT

A method for making grey iron castings having as a cardinal feature that the molten grey iron, after being made and prior to being poured into the molds, is maintained for a period of from one and one-half to two and one-half hours, preferably about two hours, at a substantially constant temperature. The resulting greatly increased homogeneity and temperature uniformity of the molten metal throughout its mass greatly improves the quality and quality control of the castings made.

5 Claims, 1 Drawing Figure

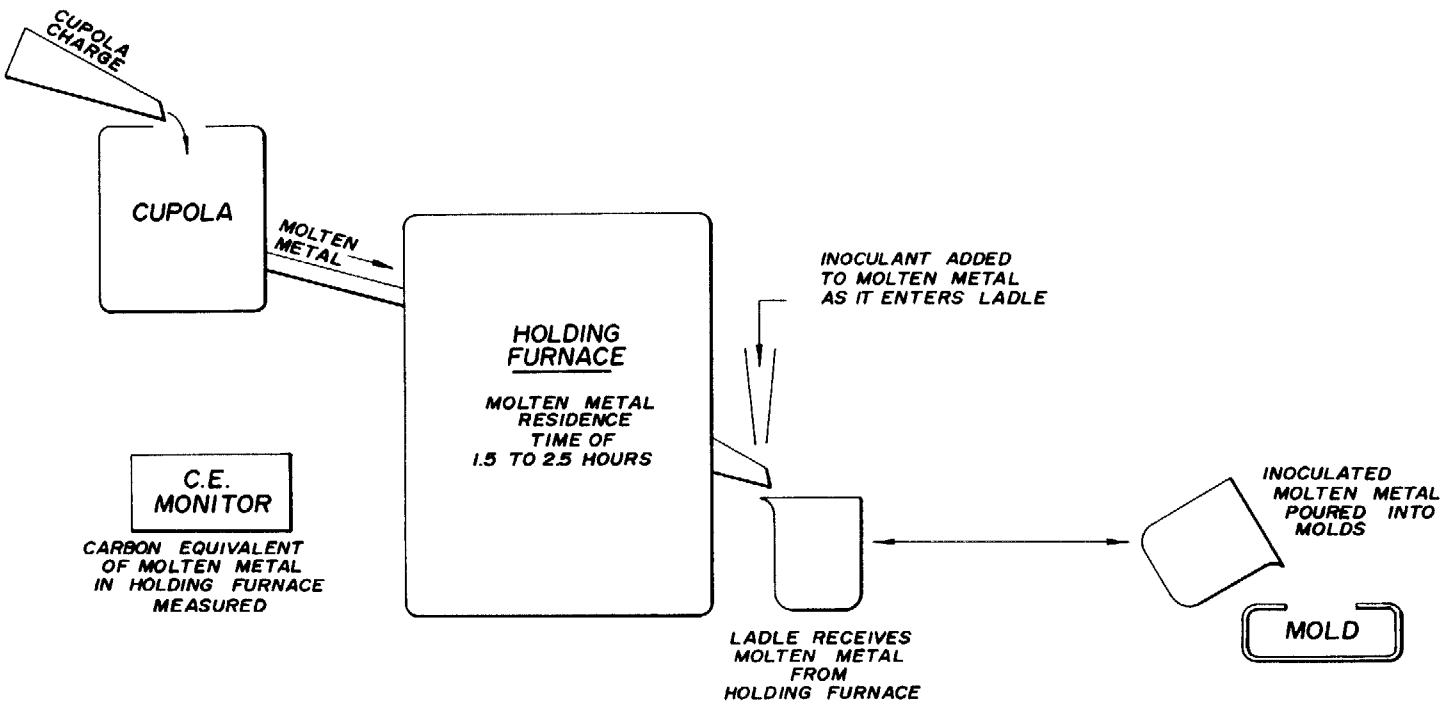
CUPOLA CHARGE
CUPOLA
MOLTEN METAL
HOLDING FURNACE
MOLTEN METAL RESIDENCE TIME OF 1.5 TO 2.5 HOURS
INOCULANT ADDED TO MOLTEN METAL AS IT ENTERS LADLE
C.E. MONITOR
CARBON EQUIVALENT OF MOLTEN METAL IN HOLDING FURNACE MEASURED
LADLE RECEIVES MOLTEN METAL FROM HOLDING FURNACE
INOCULATED MOLTEN METAL POURED INTO MOLDS
MOLD

METHOD FOR MAKING CAST IRON ENGINE BLOCKS AND THE LIKE

TECHNICAL FIELD

This invention relates to a method for grey casting, and, more particularly, to a method in which articles of grey iron can be cast with relatively thin internal wall structures without compromising the structural integrity of the casting. The invention has particular utility and advantages for making cast iron engine blocks and hence will be described particularly with reference thereto.

BACKGROUND ART

Grey casting is the term given to the method for casting grey iron. Grey iron is a pig or cast iron in which the carbon other than that of the perlite is present in the form of graphitic carbon. The important characteristic of grey iron as regards its use for engine blocks and the like is that it is machinable.

In the case of an automobile or truck, the cast engine components represent a significant portion of the gross vehicle weight. Because a reduced gross vehicle weight results in increased fuel economy, considerable attention has been given to reducing the weight of the cast engine components by reducing the thickness of the casting in certain areas, such as the cylinder block walls. The attempts which have been made in this regard have met with failure chiefly because as the wall thickness has been reduced, scrap loss has dramatically increased.

More specifically, among the important parameters affecting the lower limit on the thickness of the internal walls are the fluidity and solidification characteristics of the grey iron to be cast. In other words, the molten grey iron must be sufficiently fluid to flow into and fill relatively thin passages in the mold and have a sufficiently low solidification point so that the grey iron does not prematurely crystallize before the mold can be filled. As alluded to above, the difficulty with the processes which have heretofore been used to seek to make thin walled engine blocks has not been that the processes are incapable of making such engine blocks but rather that they are incapable of making them without a very heavy scrap loss.

Engine blocks of machinable grey cast iron are conventionally made by feeding into a cupola or other furnace the desired metallics and nonmetallics in the desired proportions such that molten cast iron of the desired chemistry is formed in the cupola, the molten metal from the cupola being conducted to a pouring station where it is poured into sand molds with the spaced supported sand cores therein. Since high quality machinable grey cast iron requires a high level of nucleation in the molten metal when it is poured, a particulate inoculant, generally ferrosilicon, is added to the molten metal just prior to the pouring operation so as to provide increased nucleation. Also, because high quality machinable grey cast iron requires that there be close control of the carbon equivalent (CE) of the metal and because the CE is a function of the silicon, carbon and phosphorous contents of the metal, the CE content of the metal prior to the inoculation is maintained lower than that desired to take into account the rise in the CE of the metal upon the addition of the inoculant.

It is, of course, necessary that the cupola or other furnace in which the molten cast iron is made have a capacity sufficient to supply the molten cast iron at the rate at which it is poured at the pouring station. To assure a continuous supply of the molten metal to the pouring station despite minor fluctuations in the output of the cupola, and to assure that there can be continued operation of the cupola despite brief interruptions or shutdowns at the pouring station, it is also conventional practice to feed the molten metal from the cupola into a small holding furnace, the metal for the pouring station being withdrawn from the holding furnace. Typically, the capacity of the holding furnace is sufficient to hold enough of the molten metal to be able to continue to supply it to the pouring station for about twenty minutes without receiving any molten metal from the cupola, and to be able to receive molten metal from the cupola for about ten minutes without feeding any to the pouring station. For example, if the metal is poured at the rate of sixty tons per hour then the cupola is operated at the same rate and the holding furnace has a capacity of about thirty tons but only contains about twenty tons during normal operation.

There is always at least some scrap loss in the manufacture of such engine blocks by reason of defects the engine blocks as cast. By far most of the defects occur in the thinnest wall portions of the castings, and the thinner the walls the greater the scrap loss. At present a scrap loss of about five percent in the casting operation is accepted by the industry as being nominal for engine blocks wherein the minimum wall thickness is about 0.180 inches. For engine blocks having substantially smaller wall thicknesses, for example, 0.150 inches, there is a dramatic increase in scrap loss, typically to as high as twenty-five percent. Such scrap losses are prohibitive as regards the manufacture of engine blocks for high production automobiles and trucks, and hence it is currently the practice in the automotive industry to design all high production engines to have engine block wall thicknesses of at least 0.180 inches. It is this limitation on the design of engine blocks that has become an ever increasing problem in the attainment of lesser gross vehicle weight.

The present invention solves this problem by providing a method whereby cast iron engine blocks can be made with wall thicknesses substantially less than are now used, without any increase in scrap loss.

BRIEF DESCRIPTION OF THE INVENTION

A cardinal feature of the method of the present invention is that after the molten grey iron is made it is held at a substantially constant temperature for a period of from one and one-half to two and one-half hours prior to being poured into the molds. Further, and in accordance with the preferred embodiment, this is accomplished by the use of a holding furnace of massively increased capacity as compared to the holding furnaces heretofore used. More specifically, the holding furnace contains during normal operation from one and one-half to two and one-half times the number of tons of molten metal required per hour for the pouring station. The chief and intended function of the holding furnace is not that of assuring a longer period of supply of the molten metal to the casting station during a cupola shutdown, but rather, the chief and intended function is as aforesaid, namely, that of greatly increasing the residence time of the molten metal in the holding furnace, at a substantially constant temperature, prior to its being fed to the casting station. That is, the holding furnace has a capacity sufficient that the residence time of the molten metal in the holding furnace during normal operation is from one and one-half to two and one-half and preferably at least about two hours. Because the temperature of the molten metal in the holding furnace is maintained substantially constant, during the lengthy residence time of the molten metal in the holding furnace there is attained not only an increase in the homogeneity of the metal composition but also an increase in the uniformity of the temperature of the molten metal throughout its mass. The increased uniformity in composition and the increased uniformity in temperature are important not only in and of themselves but are also important in better assuring a constancy in the fluidity of the molten metal. With this increased uniformity in composition, temperature and fluidity, the flow and the cooling of the molten metal poured into the mold are of improved, controlled uniformity. Further, the uniformity in composition of the molten metal as it is withdrawn from the holding furnace better assures uniformity in its nucleation when it is inoculated with the ferrosilicon or other nucleating agent.

Further in accordance with the invention, the CE of the molten metal in the holding furnace is monitored at frequent intervals, and with additions affecting the CE being made to the metal in or fed into the holding furnace if and as required to maintain the CE at the level desired, which is below that desired at the pouring station to take into account the inoculant to be added.

In the preferred embodiment of the invention a still further improvement in the castings is attained by way of the specific binders used for the molds and for the cores.

To illustrate the end result, engine blocks with a wall thickness of 0.150 inches can and have been made with the invention on a high production basis with a scrap loss of only about five percent or less. The engine blocks so manufactured provided a weight saving of about twenty percent as compared with like engine blocks having a wall thickness of 0.180 inches.

The above and other features and advantages of the invention will appear more clearly from the detailed description of a preferred embodiment which follows.

BRIEF DESCRIPTION OF THE DRAWING

The drawing schematically shows the apparatus used for the practice of the preferred embodiment of the invention.

BEST MODE FOR PRACTICING THE INVENTION

The metal formulation can be any of those well known in the art for machinable grey cast iron, preferably having a chemistry, as poured, which includes, by weight: from 3.30% to 3.60% C., from 2.10% to 2.65% Si, from 0.05% to 0.09% P, from 0.50% to 0.70% Mn, from 0.15% to 0.25% Cr, from 0.10% to 0.15% Ni, from 0.15% to 0.25% Cu, 0.15% maximum S and the remainder Fe. A typical chemistry for the practice of the invention is the following, in weight percent:

| | |
|---|---|
| C | 3.48% |
| Si | 2.30% |
| P | .07% |
| Mn | .61% |
| Cr | .19% |
| Ni | .12% |
| Cu | .21% |
| S | .15% maximum |
| Fe | remainder |

The charge ingredients used for making the molten metal can be those conventionally used typically, a combination, in the proportions required, of scrap steel and iron, coke, limestone, silicon carbide and ferromanganese.

The charge is fed by a conventional conveyor into the top of a water-wall cupola which can also be of conventional construction, though an induction furnace can, of course, be used if desired. The molten metal as made in the cupola is not of uniform temperature throughout its mass but instead is at temperatures which vary as much as 200° C. or even more, typically from about 1360° C. to 1560° C., with most of it at the upper end of this range.

The molten metal made in the cupola is continuously withdrawn therefrom at the aforesaid temperatures, varying within the range, and fed into a holding furnace which has a capacity sufficient that the residence time of the molten metal therein will be from one and one-half to two and one-half hours, preferably about two hours. The holding furnace (which, other than its size, can be of conventional construction), is heated, preferably by radiant heat from graphite or the like electrical resistance heating elements above the molten metal, to maintain the temperature of the molten metal therein at a constant level sufficiently above that desired at the time the metal is poured into the molds to compensate for the temperature drop of the metal from the time it is withdrawn from the holding furnace until it is poured into the molds. Generally, the temperature drop is about 40° C. to 50° C. and hence the molten metal in the holding furnace is heated to a temperature about 40° C. to 50° C. higher than that desired when the metal is poured into the molds. The important point is that because of the long residence time of the molten metal in the holding furnace, the metal withdrawn from the furnace is always relatively uniform, within plus or minus 15° C. of the precise temperature desired. Hence, at the pour the molten metal is likewise always within plus or minus 15° C. of that desired at the pour. Further, during the long residence time of the metal in the holding furnace, there is a great increase in the homogeneity of the metal to the end that it is of relatively uniform composition throughout as it is withdrawn from the holding furnace.

The molten metal is withdrawn from the holding furnace periodically, at regular spaced intervals, and into a ladle and a measured amount of particular inoculant, typically ferrosilicon, foundry grade, ⅜ by 12 mesh, containing, by weight, about twenty-three percent iron, about seven and one-half percent silicon, and about one percent each of calcium and aluminum is added to the molten metal in the ladle. The ladle is thereupon moved a short distance to the metal pouring station where the molten metal is poured into each of the molds as it reaches the pouring station on the production line.

In the practice of the invention mentioned above for the manufacture of cylinder blocks having internal wall thicknesses of 0.150 inches, the production line was operated at a rate requiring eighteen tons of molten metal per hour. For this operation a cupola having a capacity of twenty-five tons per hour was operated at a rate of eighteen tons per hour and the holding furnace used had a capacity of fifty tons and was maintained with forty tons of the molten metal therein. Hence, the residence time of the molten metal in the holding furnace was slightly more than two hours. For the particular metal used, the desired pour temperature, i.e. at the time poured into the molds, was 1465° C., the temperature drop of the molten metal between the holding furnace and the pouring operation being measured as about 40° C. though at times as much as 50° C. because of somewhat longer residence times of the metal in the ladle due to slight periodic delays in the production line and hence in the pouring operation. Hence, the holding furnace was heated sufficiently to maintain the temperature of the molten metal therein at about 1515° C. The molten metal entering the holding furnace from the cupola varied in temperature from 1380° C. to 1530° C.; however, the molten metal drawn from the holding furnace had a variation in temperature of only from about 1500° C. to about 1530° C. and the metal at pour into the molds had a temperature variation of only from about 1450° C. to about 1480° C. At the time of pour into the molds, the desired CE for the molten metal was 4.10%. The molten metal as made in the cupola was formulated to have a CE of four percent; however, as the molten metal entered the holding furnace there was a variation in the CE of from as low as 3.5% to as high as 4.2%. Because of the homogenization occurring in the holding furnace due to the long residence time of the molten metal therein, the CE of the molten metal in the holding furnace remained relatively constant at about the four percent level desired. In the few instances where the CE level of the metal in the holding furnace dropped significantly below four percent, an increased feed of coke into the cupola was made thereby to increase the CE of the metal entering the holding furnace with resultant adjustment of the molten metal in the holding furnace to the desired CE level of four percent. In the event the CE level of the molten metal in the holding furnace rises above four percent, a like relatively rapid adjustment to the desired CE level can be made by reducing the rate of coke feed to the cupola.

To assure the desired control of the CE of the metal in the holding furnace, a small sample of the metal in the holding furnace was taken every fifteen minutes and thermally analyzed. The analysis results were automatically fed into a conventional computer to compute the CE in accordance with the well-known formula $CE = \%TC + 0.3\ (\%Si + \%P)$, the computer providing an immediate read-out of the CE. The read-out also gave the production line operator the percentages of carbon and silicon in the sample analyzed. A sample analysis every fifteen minutes is fully adequate to insure good control of the CE.

The ladle used was of the teapot type with a two thousand pound capacity. In the pour from the ladle into the molds four hundred pounds was left in the ladle to assure against any slag entering the molds. As the molten metal entered the ladle from the holding furnace the inoculant was simultaneously added thereby causing the inoculant to be stirred into the molten metal. The amount of inoculant added generally ranged from one hundred to one hundred and fifty ounces per ladle, i.e. per sixteen hundred pounds of the molten metal, though at times as much as three hundred ounces were required. The amount of inoculant required was determined by periodically running a standard chill test on the molten metal in the ladle at the pour station, the chill depth measured by such test being indicative of the degree of nucleation as well known in the art. If the chill test showed a chill depth of below three mm, the amount of inoculant added to the subsequent ladles full of molten metal was decreased and if the chill test showed a chill depth of above five mm, the amount of inoculant added was increased. But because of the excellent homogeneity of the molten metal by reason of its long residence time at substantially constant temperature in the holding furnace, the amount of inoculant required to provide the desired chill depth within the aforesaid range remains constant for considerable periods after initial start-up to the end that there is no need to run a chill test more often then on every third or fourth ladle full of the molten metal, and with even this being on the cautious side.

With the molten metal entering the ladle at the aforesaid temperature of 1515° C. plus or minus 15° C., there can be a delay of up to ten minutes in completing the pour of the molten metal in the ladle without the temperature dropping to below the low end of the temperature range required for the pour. Normally, i.e. without there being any delay, the sixteen hundred pound pour from the ladle into the molds is accomplished in less than about four minutes.

It is, of course, required that care be taken in the preparation and assembly of the molds and cores. In this regard, it has been found that the sand molds for the practice of the invention are best made using only western bentonite (i.e. sodium bentonite) as the binder or a mixture containing at least eighty percent western bentonite the remainder southern bentonite (i.e. calcium bentonite). Also it is best that the sand cores for the practice of the invention be made using the IsoCure process the binder for which is sold by the Foundry Products Division of the Ashland Chemical Company of Columbus, Ohio, such process being described in U.S. Pat. No. 3,409,579. Briefly, the process involves the use of a cold core box and the binder system includes a phenolic resin component and an isocyanate component, these components being mixed with the sand after which the sand is molded to the desired core shape and a gaseous tertiary amine, such as dimethyl ethyl amine, is permeated through the sand to catalyze the polymerization reaction of the resin components with each other at room temperature. This enables the cores to be made at room temperature and since the cores are never hot there is no possibility of inaccuracies occurring due to shrinkage which occurs with other resin systems during cooling.

The drawing shows schematically, and not to scale, the apparatus for the practice of the invention as described above, such drawing being self-explanatory by way of its captions.

It will be understood, of course, that the longer the desired residence time of the molten metal in the holding furnace, the greater must be the capacity of the holding furnace, and increased capacity means increased capital investment. With less than a residence time of one and one-half hours, the homogeneity and temperature uniformity of the molten metal withdrawn from the holding furnace are not to a degree to provide the full advantages of the invention. One the other hand, after a residence time of about two hours the homogeneity and temperature uniformity of the molten metal are to a degree providing excellent results, and after two hours the law of diminishing returns commences to set in to the end that there is never reason to provide a holding furnace capacity for a residence time of more than two and one-half hours. In balancing capital expenditure against results, a residence time of about two hours is best.

Irrespective of the precise chemistry of the grey iron used, the proper pour temperature for pouring the grey iron into the molds will generally if not always be within the range of from about 1400° C. to 1500° C. Hence, the grey iron in the holding furnace generally if not always be maintained at a temperature within the range of from about 1420° C. to 1560° C. and about from 20° C. to 60° C. higher than the desired pour temperature, the precise temperature selected for the metal in the holding furnace depending upon the time interval, and hence the amount of cooling of the metal, between its withdrawal from the holding furnace and its pour into the molds. Using a maintenance time of about two hours in the holding furnace the temperature of the metal withdrawn from the holding furnace will generally never, if ever, be more than 20° C. higher or lower than the precise temperature selected for the holding furnace and, as indicated above, a temperature constancy within plus or minus 15° C. is more the rule.

This enables operating with close limits on the pour temperature, with resulting substantial increase in the uniformity of the molten metal as poured—uniformity in fluidity, solidification rate, etc.

The great advantage of the method of the invention is that it enables the efficient manufacture of castings having very thin walls and yet with a low scrap rate. As indicated above, the invention has been used to make cast iron engine blocks having a wall thickness of only 0.150 inches and yet with a scrap loss of only five percent or less. The weight reduction accomplished was from one hundred eighty-five pounds, for the 0.180 inch wall thickness version, to only one hundred forty pounds—almost a twenty percent reduction. However, the invention can also be used to advantage in making cast iron engine blocks and the like of greater wall thicknesses as required, for example, for diesel engines.

Hence, it will be understood that while the invention has been described specifically with reference to a preferred embodiment and a most advantageous use thereof, various changes and modifications may be made all within the full and intended scope of the claims which follow.

What is claimed is:

1. A method for manufacturing machinable grey iron castings comprising: continuously making molten grey iron in a cupola or the like metal remelting furnace, feeding the molten grey iron into a holding furnace, withdrawing molten grey iron from the holding furnace, inoculating the withdrawn molten grey iron with a nucleating agent and then pouring the inoculated molten grey iron, at a temperature of from about 1400° C. to 1500° C. into cored molds for cooling and solidification thereof thereby to form thin-walled castings for use as engine blocks and the like with nominal wall thicknesses of about 0.150 inch; the molten grey iron in said holding furnace being brought to and maintained at a relatively uniform temperature throughout its mass of from about 1420° C. to 1560° C. and from about 20° C. to 60° C. higher than the temperature of the molten metal when it is poured into the cored molds, the amount of molten grey iron in said holding furnace being from one and one-half to two and one-half times the amount withdrawn per hour from the holding furnace whereby the residence time of the molten grey iron in the holding furnace is from one and one-half to two and one-half hours; and the carbon equivalent of the molten grey iron in said holding furnace being monitored and being maintained below that desired for the molten grey iron when it is poured into the molds, the amount of nucleating agent with which the withdrawn molten grey iron is inoculated being such as to raise the carbon equivalent of the molten grey iron to that desired when the molten grey iron is poured into the cored molds.

2. A method as set forth in claim 1 wherein the holding furnace is electrically heated.

3. A method as set forth in claim 1 wherein the amount of molten grey iron in the holding furnace is about twice the amount per hour withdrawn from the holding furnace whereby the residence time of the molten grey iron in the holding furnace is about two hours.

4. A method as set forth in claim 1 wherein the molten grey iron is poured into the molds at a temperature of from about 1450° C. to 1480° C. and wherein the molten metal is maintained in said holding furnace at a temperature of from about 1500° C. to 1530° C.

5. A method as set forth in claim 1 wherein the molten grey iron made in the cupola or the like metal remelting furnace has a composition by weight of from 3.30% to 3.60% carbon from 2.10% to 2.65% silicon, from 0.05% to 0.09% phosphorous, from 0.50% to 0.70% manganese, from 0.15% to 0.25% chromium, from 0.10% to 0.15% nickel, from 0.15% to 0.25% copper, 0.15% maximum sulphur and the remainder substantially all iron; wherein the carbon equivalent of the molten grey iron in the holding furnace is maintained at about 4%; and wherein the inoculation with the nucleating agent is such as to raise the carbon equivalent of the grey iron to about 4.1%.

* * * * *